United States Patent [19]

Sutter

[11] 4,367,612

[45] Jan. 11, 1983

[54] COMPOSITE SUPPORTING STRUCTURE

[75] Inventor: David L. Sutter, Kennebunkport, Me.

[73] Assignee: Hussey Manufacturing Company, North Berwick, Me.

[21] Appl. No.: 139,783

[22] Filed: Apr. 14, 1980

[51] Int. Cl.[3] ..... E04H 3/12

[52] U.S. Cl. ..... 52/9; 52/732

[58] Field of Search ..... 52/732, 633, 721, 693, 52/695, 720, 9

[56] References Cited

U.S. PATENT DOCUMENTS

| | | | |
|---|---|---|---|
| 952,016 | 3/1910 | Phipps | 52/720 |
| 2,162,301 | 6/1939 | Gleason | 52/720 X |
| 2,733,786 | 2/1956 | Drake | 52/633 |
| 3,284,971 | 11/1966 | Attwood | 52/720 X |
| 3,353,320 | 11/1967 | Grasis | 52/693 |
| 4,041,655 | 8/1977 | Pari | 52/9 |

*Primary Examiner*—Price C. Faw, Jr.
*Assistant Examiner*—Carl D. Friedman
*Attorney, Agent, or Firm*—Robert B. Russell

[57] ABSTRACT

Apparatus is provided for supporting structures employing a free-standing column of angular cross-section having flanges of substantially equal length and an included angle between the flanges of between about 80° and 45°. A specific embodiment employs the column in combination in a telescoping grandstand structure.

1 Claim, 11 Drawing Figures

COMPOSITE SUPPORTING STRUCTURE

FIELD OF THE INVENTION

The present invention relates to supporting structures, and more particularly to columns, struts or braces designed to bear loads applied axially thereto. The invention is suitable for use in a wide variety of structures such as transmission line towers, wind-mill towers, scaffolding, grandstands and many others. A particularly advantageous use of the invention is in telescoping grandstands and seating equipment adapted for use in gymnasiums, for example, where they may be pushed to the side of the room when not in use.

BACKGROUND OF THE INVENTION

The analysis of the efficiency and efficacy of supporting structures requires an understanding of the elements of strength of the materials involved. Thus, when a column is subjected to an eccentrically applied axial load, the column will bend in response to the degree and direction of eccentricity. In addition, once bending is initiated further bending takes place in the plane defined by the centroid of the column and the point of application of the load; the resistance of the column to bending in that plane ultimately determines the load bearing capacity of the column.

If a vertically disposed column is a cylinder or a tube, and the force is applied concentrically, the resistance of the column to bending will be equal in all directions because the material is placed uniformly around the axis and no bending below maximum load (critical stress) takes place. If the column, however, has an irregular cross-section, then the column will fail by bending on its axis of least resistance; i.e. the principal axis of the section about which its radius of gyration is least.

When a column bends, the fibers in the material of the column which resist the bending are subjected to tension on the outside of the bend and compression on the inside, between which lies a "neutral axis" running from end to end of the column where there is neither tension nor compression. The resistance to bending is provided by all the fibers which are not on the neutral axis and since the fibers which are farthest from the neutral surface are subjected to the greatest amount of deformation during bending, they contribute the most to the resistance. The relative resistance to bending can be determined by calculating the radius of gyration of the structure in question for its various bending axes*. Thus, the weakest direction of bending of a column (i.e. the axis of least resistance to bending), is the direction in which the radius of gyration is the least.

*(More specifically, the radius of gyration r conforms to the following formula:

$$r = \sqrt{\frac{I}{A}}$$

where I is the amount of inertia, A is the area).

Accordingly, hollow tubes make the best columns because they provide a maximum radius of gyration in all directions. Although hollow rectangular shapes are somewhat weaker than tubes, all other things being equal, they also make good columns. They have certain practical advantages over tubes in that they are easier to attach to other structures and they are usually cheaper. An important requirement for all hollow shapes, however, is to have a continuous, unbroken surface. Thus, a tube or other hollow shape which has an open seam in its surface is very much weaker than if the surface is integral and continuous. It follows that I, H or channel cross-sections are weaker than enclosed hollows for essentially the same reason. The free edge of a flange has nothing other than its own rigidity to keep it from buckling. Of course, even though I, H and U cross-sections are weaker than tubes and hollows, they are often used in preference thereto because they are cheaper and more readily available. Also, I, H and U shapes can be easily incorporated into other structures which combine with them to give at least in part the effect of a hollow structure. Even less desirable for free standing, load bearing columns, struts, or braces, are simple angle irons which traditionally comprise a pair of flanges disposed at right angles to each other, often with one of the flanges being wider than the other. Usually, several angle irons will be combined to form a composite structure in which the maximum radius of gyration of one angle iron is aligned so as to reinforce the least radius of gyration of an adjacent angle iron and thereby to attain, at least in part, some of the advantages of the more complicated enclosed cross-sections. Another disadvantage of the traditional angle iron is that the centerline of the column (the centroid) lies between the two flanges. Thus, if the load is to be applied in the optimal manner, i.e. with the thrust axis on the centroid, a bridging connection to both flanges is required. Otherwise, simply connecting the load to one flange of the column subjects the column to an undesirable bending stress arising from the eccentricity of the connection. In addition, simple angles tend to twist under loading and this, in turn, complicates the predictability of their maximum loading condition.

Due to the low cost and ready availability of the traditional angle iron, however, as well as the relative ease with which simple right angled cross-sections can be cross-braced or combined with other elements to form composite structures in which the various columns or braces reinforce each other, such conventional angle irons have been widely used as columns in supporting structures.

A typical illustration of such a useage has been in telescoping grandstand seating structures adapted to be pulled from a stowed, telescoped position (usually against a wall) to a fully extended position set up for use. In such structures, the individual tiers of seats are supported independently on vertical columns which are fitted with rollers at their bases on which the tires are rolled out or in between the stowed and set-up positions. When the tiers are rolled into the stowed position, each lower tier together with its entire supporting columns and braces must nest within the supporting columns and braces of next above tier. Normally, hollow rectangular cross-sections are employed for the side columns at the outer ends of the tiers, and the center portions of the tiers are supported by angle iron columns connected diagonally between the bases of the side columns and the center portions of the tiers, the diagonal disposition of the angle irons being dictated by the need for bracing the stand against lateral swaying. The use of angle irons is also desirable in the specific context because angle irons can nest conveniently and it is desirable to use them so that telescoping the tiers can be done within the smallest space possible. On the other hand, in order to achieve efficient nesting, the connection of the load to only one flange of the column is desirable. This, of course, subjects the column to bending stress due to eccentric application of the load and requires the use of larger and heavier angle irons. Still another factor requiring the use of larger and heavier angle irons has to do with the "slenderness ratio" of the column. Obviously as the length of an unsupported column of a given cross-section is increased, its resistance to bending and hence its maximum load bearing capacity decreases. The slenderness ratio is a factor which is used to judge the efficiency of unsupported columns, and to indicate when a given cross-section has reached its maximum safe length. The slenderness ratio is determined by dividing the length of the column by the least radius of gyration of the column. The American Institute of Steel Construction has established a slenderness ratio of 200 as maximum for unsupported columns, struts or braces, and this requires the use of substantially larger and heavier angle irons for the long, compression members needed to support the upper tiers of the grandstand seating structures described.

The present invention stems from the discovery that the conventional angle iron, when used as an unsupported column, makes an inefficient use of the metal. For example, with an angle iron having 1" flanges and a thickness of 12 gauge (0.1045") the maximum radius of gyration is 0.803, whereas the minimum radius of gyration is less than half of that, i.e. 0.392. The column, of course, has no greater resistance to bending than the resistance thereto on its weakest axis, but the fact that on other axes, the column has much greater resistance reveals that the column is not making use of the full potential of its metal.

Accordingly, a basic object of the present invention is to provide a more efficient column which employs the advantages of the conventional angle iron, of simplicity, cost, ready producibility, availability, and ease of incorporation into other structures, which also uses the material of the cross-section more efficiently so as to provide less expensive and lighter columns than conventional angle irons having the same load bearing capacity. Another object is to provide such a column which is suitable for use as a compression bearing, unsupported, pin connected column, brace or strut. A further object is to provide such a column meeting the foregoing objects which is also suitable for nesting together with a multiplicity of other, like columns, and to which the load may be connected at only one flange with a significant reduction in bending stress due to eccentricity of connection as compared to conventional angle irons.

BRIEF DESCRIPTION OF THE INVENTION

The present invention is based on the finding that a substantially more efficient use of the metal can be made if the two flanges of a simple angle iron are bent inwardly to an included angle of, optimally, 58°. The effect of bending the flanges inwardly is, of course, to reduce the resistance of the column to bending on its strongest bending axis. By so doing the value of the column is reduced for uses in which the column is to be incorporated with other elements designed to reinforce it on its weakest bending axis. On the other hand, where the intended use is as an unsupported, pin connected column, strut, or brace, as, for example, in the context of telescoping grandstands, the loss of resistance on the strongest bending axis is unimportant provided a gain can be made on the weakest axis. A calculation of the radius of gyration of the weakest bending axis for various angles reveals a significant improvement can be attained, even though a proportionally greater loss is suffered on the strongest axis. Thus, for a column of 12 gauge steel having equal 2" flanges, the respective radii of gyration r on the axis W of maximum strength (the axis of symmetry of an equal-legged angle), and on the axis of Z of minimum strength calculate as follows for the following included angles:

| Included Angle | $r_W$ | $r_Z$ |
|---|---|---|
| 90° | 0.803 | 0.392 |
| 85° | 0.775 | 0.412 |
| 80° | 0.746 | 0.431 |
| 75° | 0.715 | 0.449 |
| 70° | 0.684 | 0.467 |
| 65° | 0.651 | 0.484 |
| 60° | 0.617 | 0.501 |
| 55° | 0.583 | 0.518 |
| 50° | 0.548 | 0.535 |
| 49° | 0.540 | 0.540 |
| 45° | 0.512 | 0.552 |

These figures assume concentric loading. However, although the calculated radii of gyration are equal under these conditions at an included angle of 49°, one cannot conclude that 49° is the optimum angle because other factors such as twisting under stress are at play especially with eccentric loading and non-vertical positioning which factors are extremely difficult to avoid entirely. On the other hand, since it is necessary to provide reliable standardized loading, and to avoid the uncertainties of bridging structures employed for concentric loading, in a preferred embodiment of the invention, the column is loaded on the centerline of one flange. When this is done, the actual testing of columns shows that the optimum included angle for a column having flanges of equal length is about 55°.

By way of illustrating the advantages to be gained from the invention, for example, when a 2 ½" × 2 ½" × 12 ga. column having a slenderness ratio of 200 is subjected to an axial load of 1.5 kips, which is resisted at connecting points on one flange on the w axis, the column will be loaded to only 80% of its capacity if the included angle is 60°; whereas if the included angle is 90°, the gauge of the steel of the column must be increased to slightly greater than 10 ga. in order for the 90° column to equal the load bearing capacity of the lighter 60° column. This represents an increase of over 28 ½% of the weight of the steel.

Another benefit of reducing the included angle according to the present invention is that significantly less bending stress is introduced into the column when the load is connected eccentrically to a flange, than with conventional angle irons. This is due to the fact that, when the included angle is reduced, the eccentricity is likewise reduced.

The benefits of the present invention commence being felt as soon as the included angle is reduced below 90°. Significant savings in metal either by reduction of flange length or by reduction of gauge can be achieved by reducing the included angle to about 80° and therefore 80° may be regarded as the angle at which significant use of the invention commences. At the other end of the scale, when the included angle of the column drops below 45°, the loss of strength on the weakest axis reduces the strength of the column so much that the significant benefits of the invention begin to disappear. Accordingly, the range of included angles employing the significant use of the invention is between about 80° and 45°.

The benefits of the present invention may also be expressed in terms of the length of the column for a given weight of a metal, a given slenderness ratio, and a given load bearing capacity. Thus, if, in the design of a column, the weight of the metal, the slenderness ratio, and the load bearing capacity of the column are each fixed, the column of the present invention can be significantly longer than a conventional 90° angle iron, thereby permitting taller structures of equal weight. Conversely, if the length is fixed, lighter structures of the same height equal in all other aspects, can be built. Again, in this context, the range of angles between about 80° and 45° defines the range of significant use of the invention.

In the special context of telescoping structures such as telescoping grandstands, reduction of the included angle tends to reduce the ability of the columns to nest mutually, and it becomes necessary to strike a balance between improvement in the efficiency of the column, and the requirements of nesting. In a specific preferred embodiment of the invention, an included angle of 60° is employed as an effective compromise providing major improvement in manufacturing as well as in the structure, with the added advantage of suitability for nesting in the telescoping grandstand context.

DETAILED DESCRIPTION OF THE INVENTION

A preferred embodiment of the present invention is compared to the prior art in FIGS. 4(*a*), 4(*b*), 4(*c*) and 4(*d*) in which columns having the cross-sectional shape of the two upper components shown in FIG. 4(*a*) and FIG. 4(*b*) are classifiable as conventional 90° angle irons (or other material) and the shapes represented by c and d illustrate columns coming within the present invention, employing a 60° included angle of a specific preferred embodiment, between their respective flanges. The columns may be hot rolled in a rolling mill or they may be cold formed from a a coil of flat stock. As long as the connection between the flanges is reasonably sharp, the underlying basis for the invention applies to columns shown in FIG. 4(*c*) and FIG. 4(*d*).

A special advantage of the acute angle between the flanges of shapes shown in FIG. 4(*c*) and FIG. 4(*d*) is that the least radius of gyration is subtantially greater than for the 90° angled shapes shown in FIG. 4(*a*) and FIG. 4(*b* ). As explained in the introduction above, reduction of the included angle to about 80° brings about important advantages which remain until the included angle is reduced to about 45°. For non-eccentric connection, a maximum of improvement appears at about 55°. Since the eccentricity of connection to a single flange is substantially less in shapes shown in FIG. 4(*c*) and FIG. 4(*d*) than in shapes shown in FIG. 4(*a*) and FIG. 4(*b*), connecting the load eccentrically to columns so designed to a single flange introduces less bending stress than with shapes shown in FIG. 4(*a*) and FIG. 4(*b*). Actual tests have shown that an angle of about 55° provides the optimal balance for single flange connection.

Figure 2:
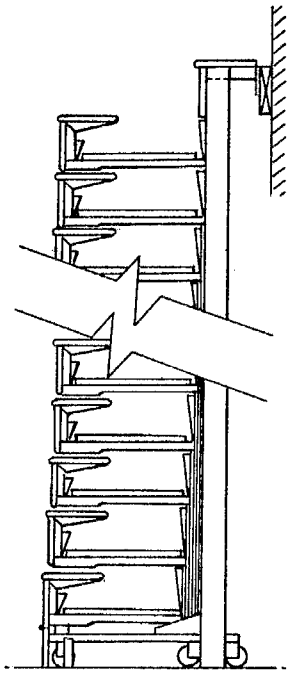
FIG. 2 is a view in side elevation of the grandstand of FIG. 1 in the retracted or closed position.
Figure 5:
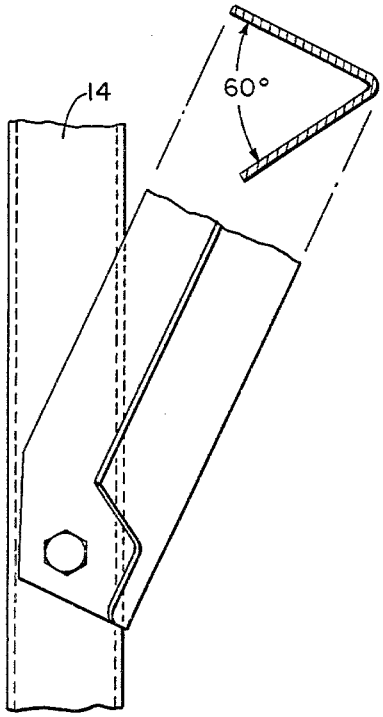
FIG. 5 is a view in rear elevation showing how a column according to the present invention is connected to one of the support columns of a tier.
Figure 6:
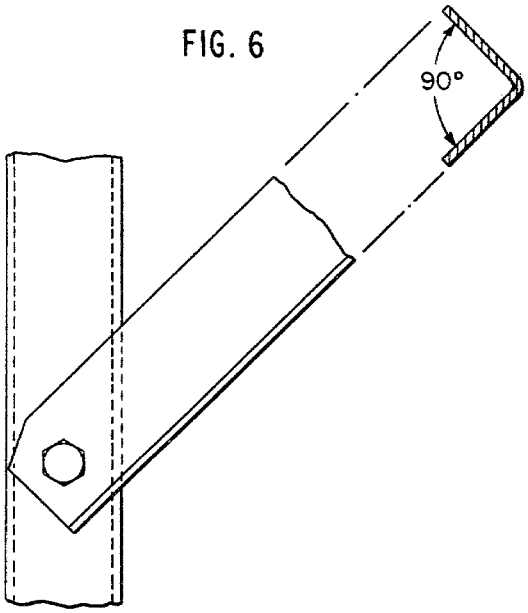
FIG. 6 is a view in rear elevation showing how a conventional 90° angle iron is attached.
Figure 7:
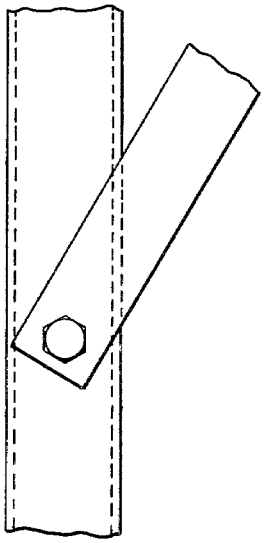
FIG. 7 is a view in rear elevation showing how one of the flat braces employed is attached.
Figure 8:
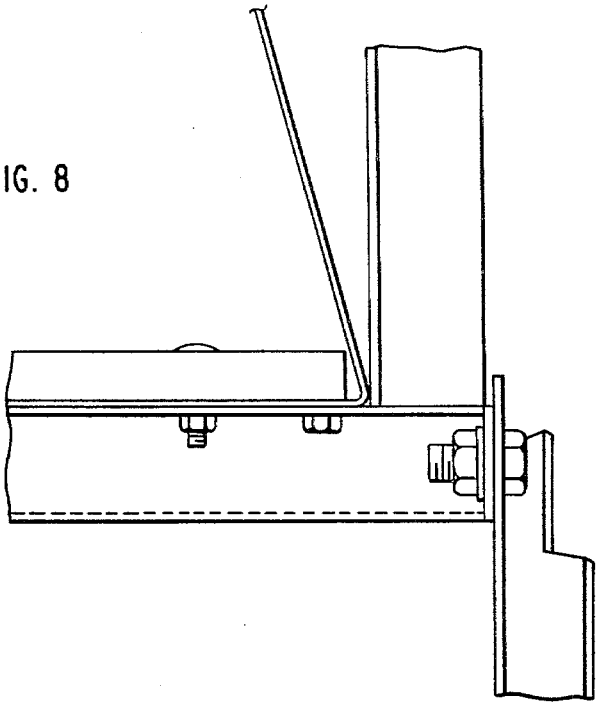
FIG. 8 is a view in side elevation showing how the upper end of a column made according to the invention is attached to the seating element of a tier.
Figure 9:
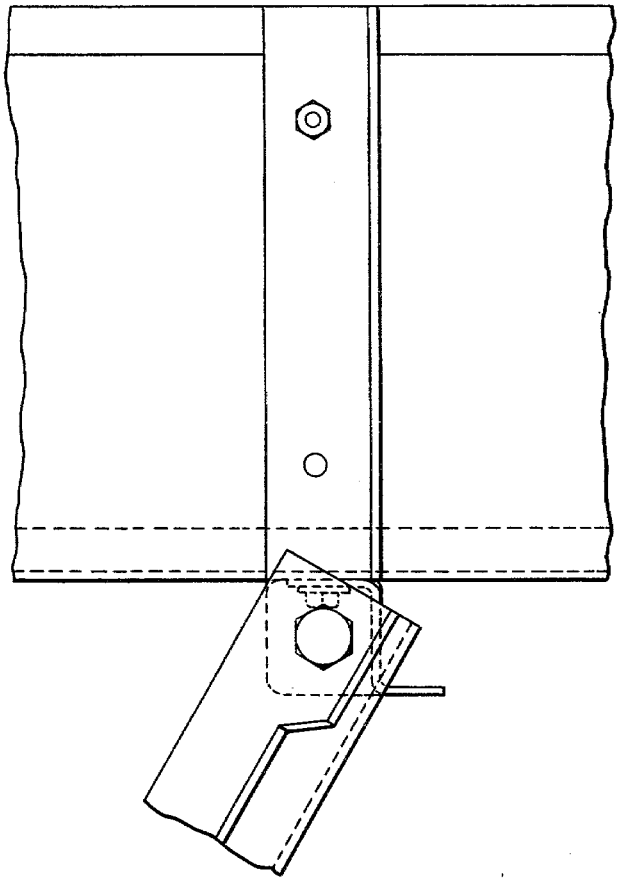
FIG. 9 is a view in rear elevation of the elements of FIG. 7.

A typical use for the columns of the present invention is in telescoping grandstands (sometimes referred to as retractable bleachers) adapted to move from a set-up position (see FIG. 1) to a telescoped or retracted position, usually against a wall (see FIG. 2). The stand comprises separate tiers of seats 10 each mounted on a rectangular frame including rear side posts 14 (see FIG. 1 where one front side post is broken away to show the rear side post 14. See also FIG. 5), horizontal seat and deck supports 16, and horizontal bases 18 mounted on rollers 20. The rectangular frames are basically the same for each tier except for their height. Side posts 12 and 14 are preferably hollow rectangular cross-sectioned columns.

Figure 1:
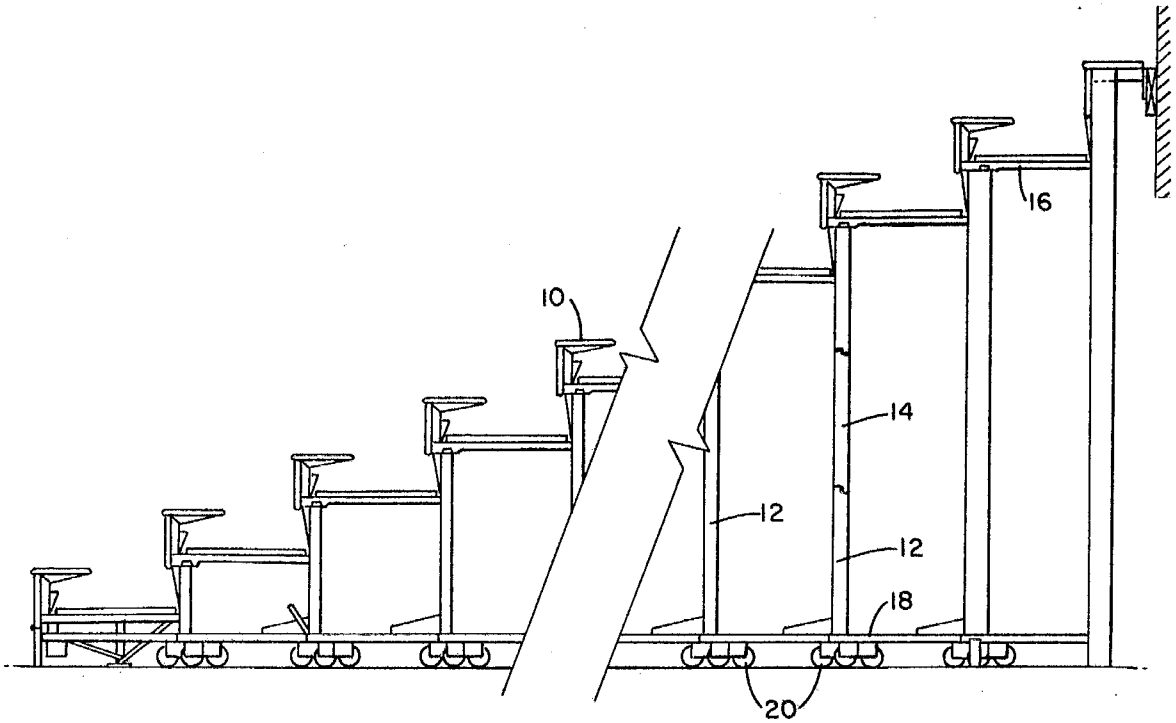
FIG. 1 is a view in side elevation, partially broken away, of a telescoping grandstand in the set-up position employing columns according to the present invention.
Figure 3:
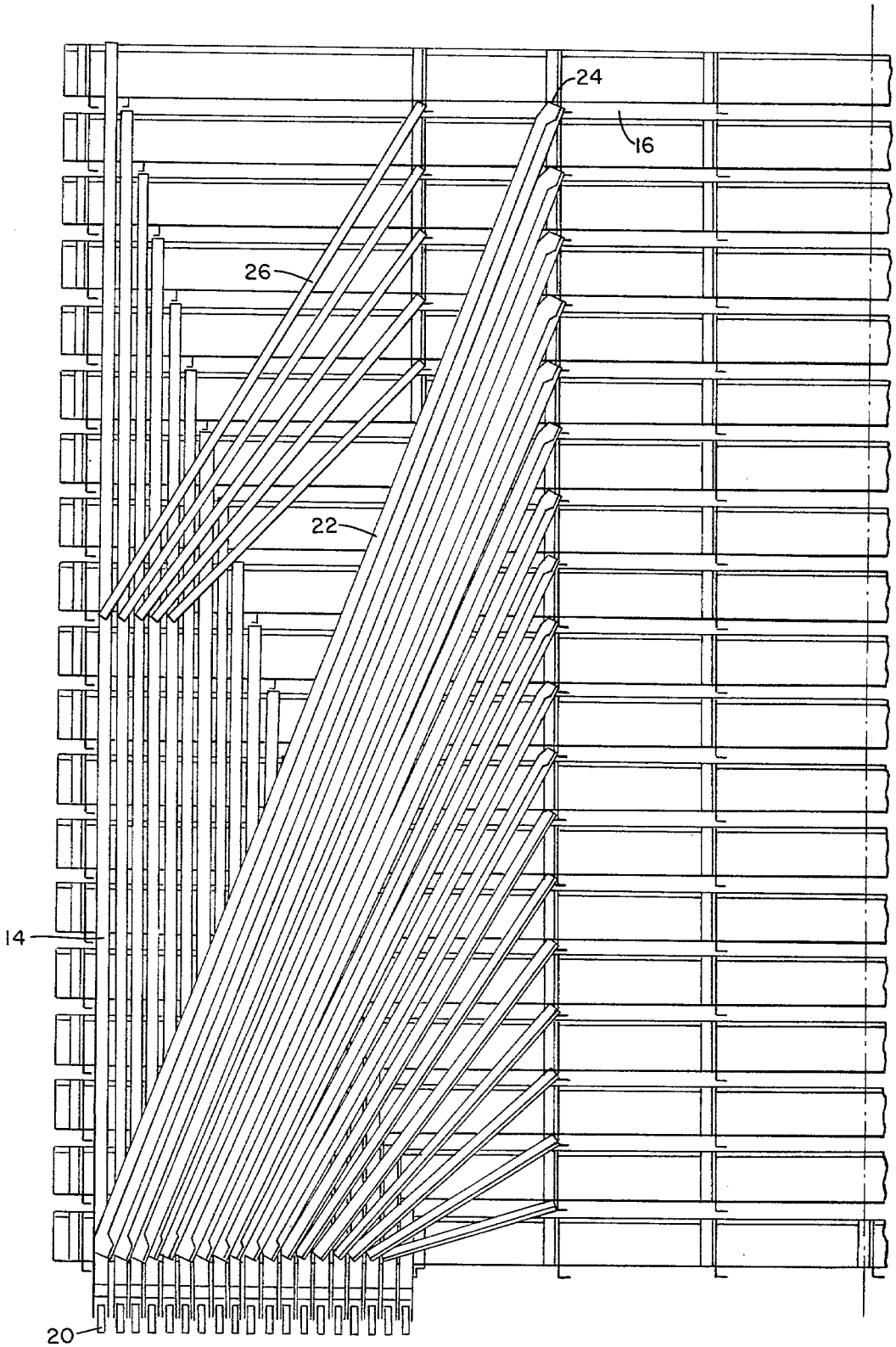
FIG. 3 is a view in rear elevation of one half only of the grandstand of FIGS. 1 and 2 showing how each tier and all of its supporting components nests below and within the supporting components of the next above tier.
Figure 4A:
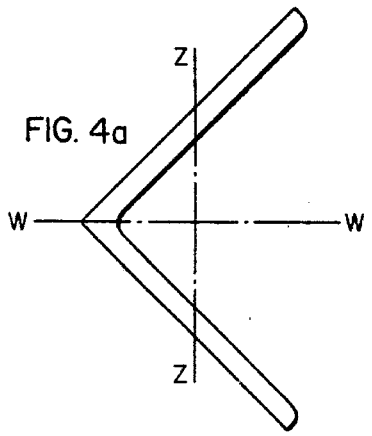
PRIOR ART FIG. 4a
FIGS. 4(*a*), 4(*b*), 4(*c*), and 4(*d*) are diagramatic views comparing conventional angle iron shapes with embodiments of the present invention, showing their respective maximal and minimal bending axes and the dimension of eccentricity for connecting a load to a single flange thereof.
Figure 4B:
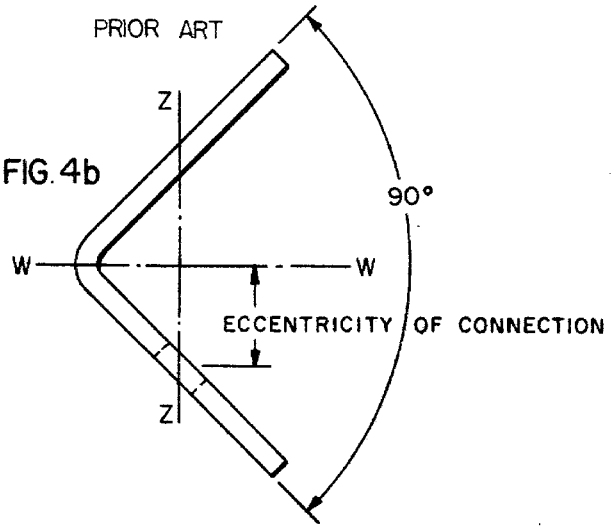
PRIOR ART FIG. 4b
Figure 4C:
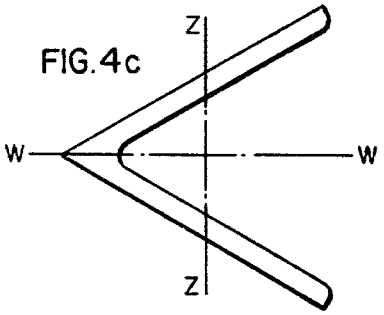
Figure 4D:
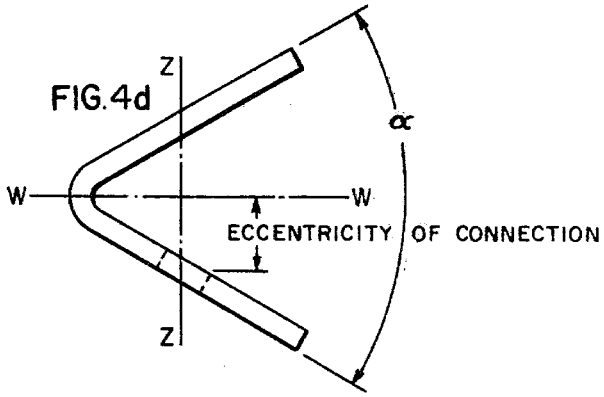

FIG. 3 illustrates the left hand half of the grandstand of FIGS. 1 and 2 viewed from the rear, it being understood that the right hand half of the grandstand is the same except in mirror image, and, therefore, need not be illustrated or described.

As stated, each tier is basically separate and, except when the stand is in the fully set up position with the tiers interlocked (by mechanism not shown), the tiers are free to move independently on rollers 20. Thus if one starts at the left side of the grandstand (also at the left of FIG. 3), the side posts 12 and 14 at the extreme left belong to the uppermost tier and they support the ends of the seat and deck supports 16 of the uppermost tier. The seat and deck supports 16 of the uppermost tier are also supported centrally by column 22 the upper end of which is secured to the seat and deck supports 16 at 24 and the lower end of which is secured to the base of post 14. The column 22 thereby assumes a diagonal position which braces the grandstand against lateral swaying. In the upper middle area of the rear side posts 14 for the upper tiers, a second diagonal brace 26 is interconnected between the deck support 16 and post 14. Brace 26 is flat and it serves only in tension to counteract the outward bending force which a load applied to column 22 exerts on post 14 acting about the pivot axis formed by rollers 20.

Figure 10:
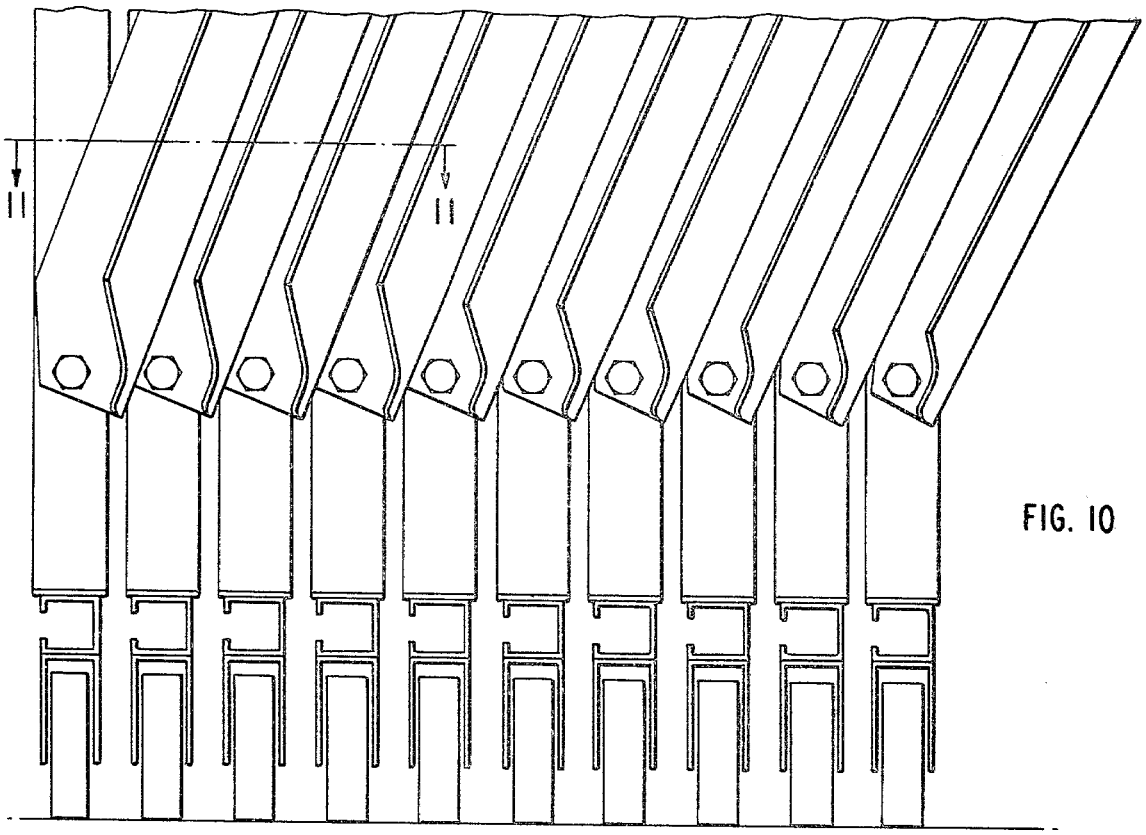
FIG. 10 is a fragmentary view in rear elevation showing how the columns nest.
Figure 11:
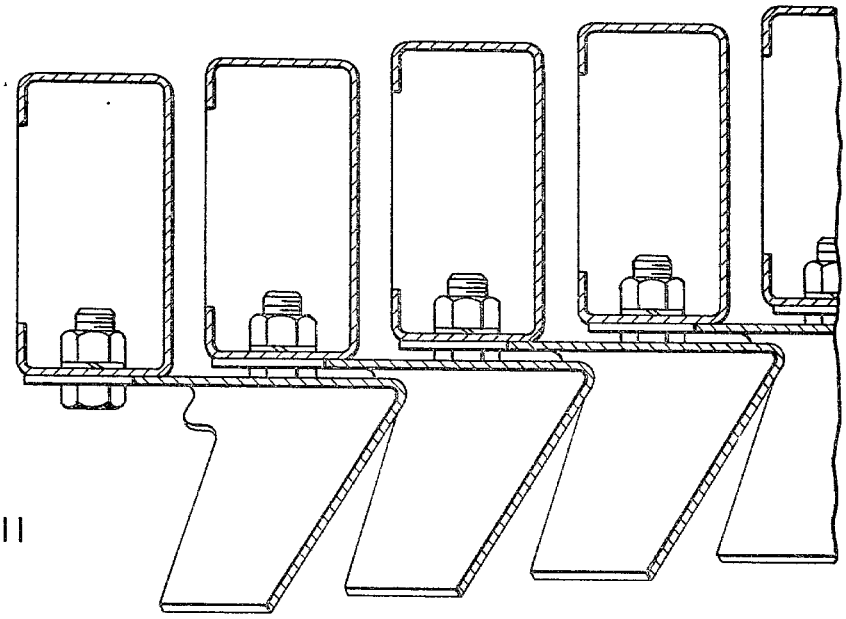
FIG. 11 is a fragmentary view in cross-section showing how the columns overlap in nesting relation.

Column 22 is the column in the grandstand structure which employs the angle advantage of the present invention. It is bolted to the rear of post 14 (see FIG. 5), with one flange flush with the rear face of post 14, and the other flange extending to the rear at an angle of 60°. Columns 22 are at the rear of the rectangular frame which supports the seats, and each tier, therefore, presents an opening below its deck supports 16 and between its respective side posts 12 and 14 sufficient to receive the next below tier in telescoping relation. In order, however, to make the tiers fit as close together as possible, and also to minimize the length of unsupported deck inwardly of the side posts 12 and 14 of the lower most tiers, columns 22 are nested in the retracted position with their flanges in overlapping relation (see FIGS. 10 and 11). It is for this additional reason (as well as for manufacturing convenience) that the angle of 60° has been selected for this particular use. With an angle of 60° a major benefit in terms of increase of efficiency of the column is obtained without sacrificing too much nesting efficiency. The optimal angle of 55° is not employed both because a standardized, reliable single flange connection is required, and because the rearward extending flange at an angle of 55° would increase the risk of interference between the columns during nesting.

Columns 22, in the example shown are only used for tiers numbers 9–19. Below tier no. 9 a conventional 90° angle iron is used because from this location on in the structure the support demands for the columns are so minimal that the benefits of the invention are not needed. In addition, the nesting requirements are accentuated and 90° angles are desired because they nest better at this point in the structure.

In columns 22 the following dimensions and gauges are employed:

| Lengths | Flanges | Gauge |
|---|---|---|
| 9th thru 12th tier 84", 96", 106", 115"; | 2½ × 2½ | 12 |
| 13th thru 15th tier 125", 135", 147"; | 3 × 3 | 12 |
| 16th thru 19th tier 156", 165", 175", 184"; | 3½ × 3½ | 12 |

In each case, if conventional 90° angle irons had been employed, two additional gauges of thickness would have been required in order to meet the loading and slenderness ratio requirements of the design, i.e. a difference of 28% in weight, and a proportional major increase in cost of raw material. Of course, if a conventional 90° angle iron were cross-braced against bending on its weakest axis, it would have greater load bearing capacity than the column of the present invention, but in that case the column would not be unsupported. Moreover, such cross-bracing would interfere with nesting, to say nothing of introducing extra weight, and extra material and extra labor costs.

Numerous applications of the invention herein described will be apparent to those skilled in the art, and although the combination in a nesting grandstand is considered inventive as a combination, the column itself is also considered inventive as an unsupported column having many potential uses. Accordingly, the invention should not be condidered as confined to the specific grandstand application, but limited instead only in terms of the appended claims.

I claim:

1. A composite telescoping support structure comprising:

at least a first open rectangular load supporting frame having a frontwardly facing central open area, said open centralarea forming a cavity of substantially the same shape as said first frame;

at least a second open rectangular supporting frame having a shape substantially the same as but slightly smaller than the central open area of said first frame;

said second frame fitting within the central open area of said first frame in telescoping relation;

means for bracing said first frame against lateral swaying comprising a first unsupported diagonally mounted column flush with the rear of said first frame, means for bracing said second frame against lateral swaying comprising a second diagonally mounted column flush with the rear of said second frame, said columns each comprising two substantially equal flanges set at an angle between about 80° to 45°, means including rollers for moving said second frame from a stowed position within said first frame to a use position adjacent to but in front of said first frame, and said second diagonally mounted column connected to said second frame in substantially parallel relation to said first column;

said first and second columns in abutting and partially overlapping relation when said frames are in the stowed position.

* * * * *